US011456131B2

(12) United States Patent
Kang et al.

(10) Patent No.: US 11,456,131 B2
(45) Date of Patent: Sep. 27, 2022

(54) SWITCH ASSEMBLY

(71) Applicant: Ford Global Technologies, LLC, Dearborn, MI (US)

(72) Inventors: Derek Kang, Nanjing (CN); Patrick Xu, Nanjing (CN); Daniel Weckstein, West Bloomfield, MI (US); Dai Yang, Nanjing (CN); Shannon Carloni, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 583 days.

(21) Appl. No.: 16/654,452

(22) Filed: Oct. 16, 2019

(65) Prior Publication Data

US 2020/0168413 A1 May 28, 2020

(30) Foreign Application Priority Data

Nov. 26, 2018 (CN) ..... 201811415164.5

(51) Int. Cl.
*H01H 23/14* (2006.01)
*H01H 23/00* (2006.01)
*H01H 23/28* (2006.01)

(52) U.S. Cl.
CPC ..... *H01H 23/143* (2013.01); *H01H 23/006* (2013.01); *H01H 23/28* (2013.01)

(58) Field of Classification Search
CPC ..... H01H 21/50; H01H 23/28; H01H 23/143; H01H 23/006; H01H 3/50; H01H 9/02; H01H 13/02; H01H 13/14
See application file for complete search history.

(56) References Cited

U.S. PATENT DOCUMENTS 4,524,253 A 6/1985 Sorenson
5,735,392 A 4/1998 Shirasaka
6,797,898 B2 * 9/2004 Heinze ..... B60Q 1/1469 200/332

(Continued)

FOREIGN PATENT DOCUMENTS

CN 106683933 A 5/2017
DE 2927492 A1 2/1981

(Continued)

*Primary Examiner* — Edwin A. Leon

(74) *Attorney, Agent, or Firm* — Vichit Chea; Price Heneveld LLP

(57) ABSTRACT

A switch assembly comprises a button, a pivoting element, a first positioning element, and a second positioning element. The button has a first, second, and third states. The pivoting element extends from a height direction of the button, and has first and second contact parts arranged in the height direction. Surfaces of the first and second contact parts have different contours. The first positioning element and the second positioning element respectively correspond to the first contact part and the second contact part, and are movable relative to each other. A function of the first positioning element and a first positioning section of the first contact part is configuring the first state, and functions of the second positioning element and a second positioning section and a third positioning section of the second contact part are respectively configuring the second state and the third state.

20 Claims, 9 Drawing Sheets

(56) References Cited

U.S. PATENT DOCUMENTS

| | | | | |
|---|---|---|---|---|
| 6,841,751 | B2 * | 1/2005 | Sasaki | H01H 23/168 200/563 |
| 6,888,080 | B2 * | 5/2005 | Sasaki | H01H 23/025 200/559 |
| 6,974,919 | B2 * | 12/2005 | Mori | H01H 23/143 200/61.54 |
| 7,528,335 | B2 * | 5/2009 | Lanser | B60Q 3/82 200/252 |
| 7,834,286 | B2 | 11/2010 | Michel et al. | |
| 2018/0144888 | A1 | 5/2018 | Wong | |

FOREIGN PATENT DOCUMENTS

| | | | |
|---|---|---|---|
| DE | 102012011983 | A1 | 12/2013 |
| GB | 834389 | | 5/1960 |
| GB | 2068172 | B | 7/1984 |

* cited by examiner

[FIG. 1]
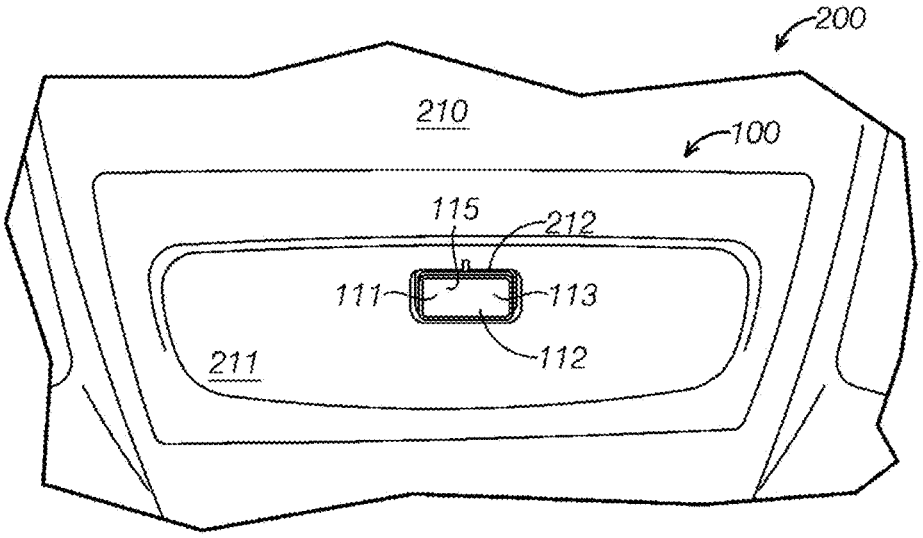
[FIG. 2]
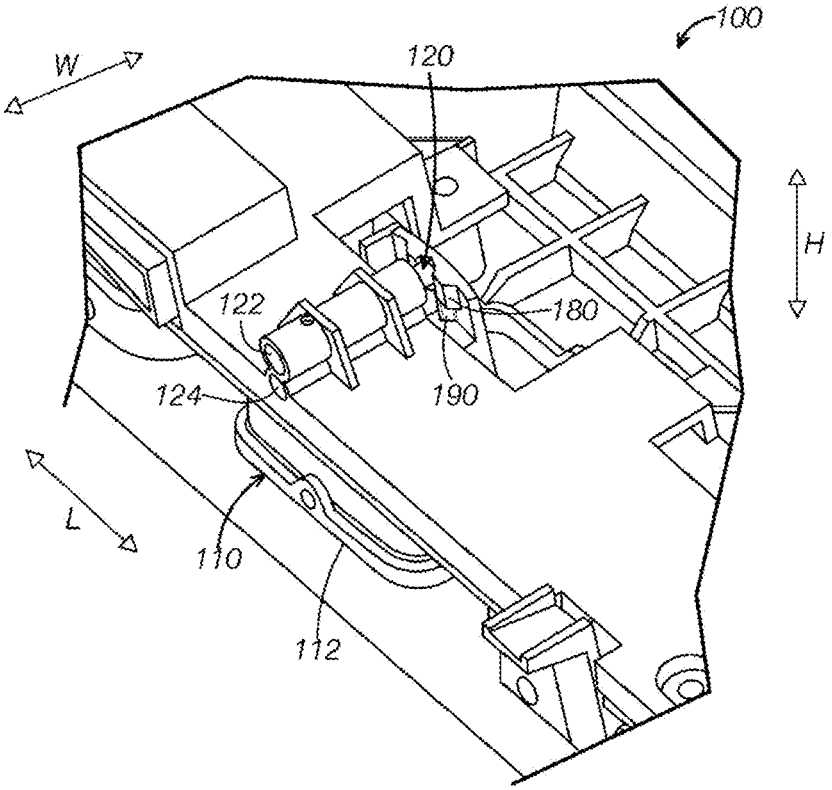

[FIG. 3A]
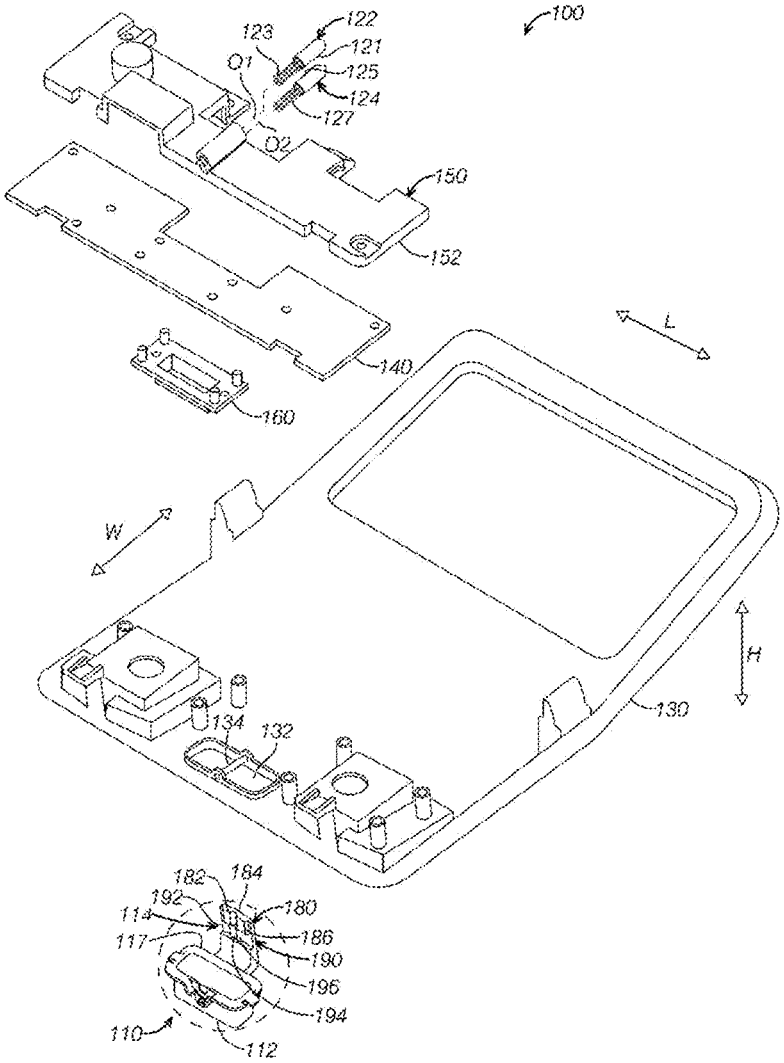
[FIG. 3B]
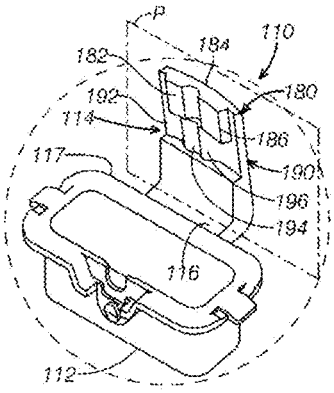

[FIG. 4A]
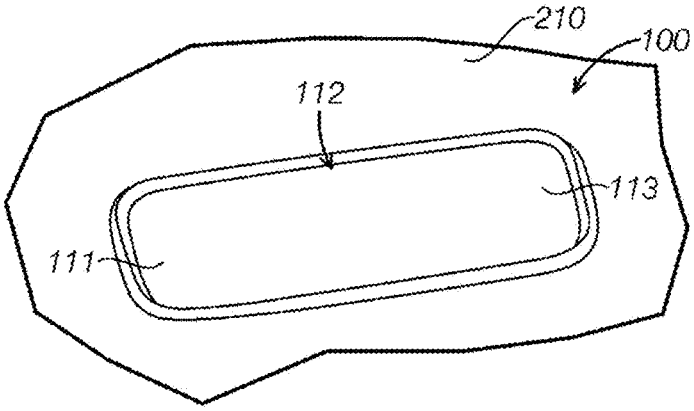
[FIG. 4B]
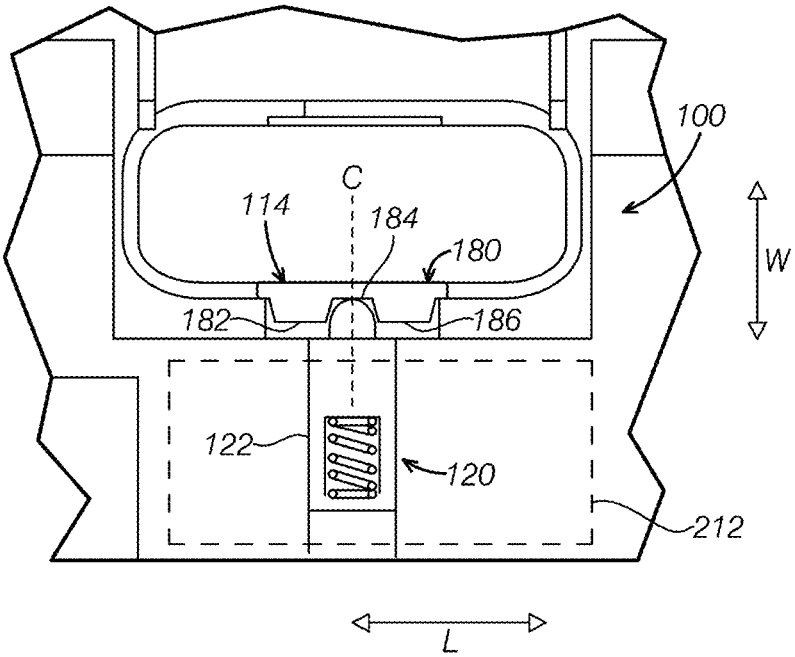

[FIG. 4C]
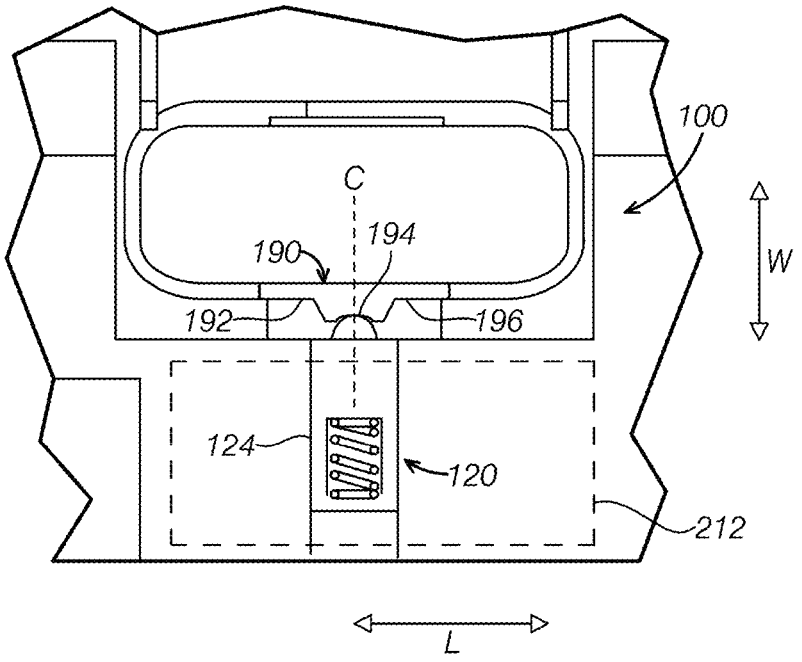
[FIG. 4D]
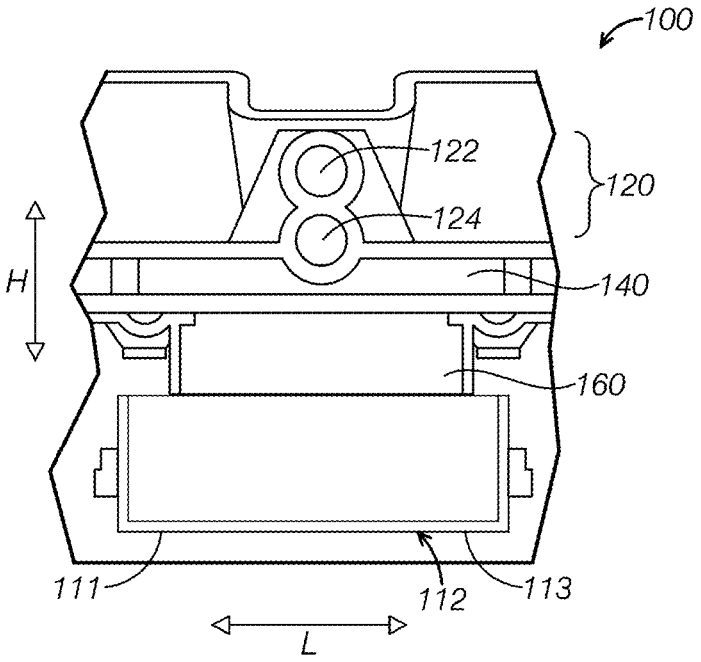

[FIG. 5A]
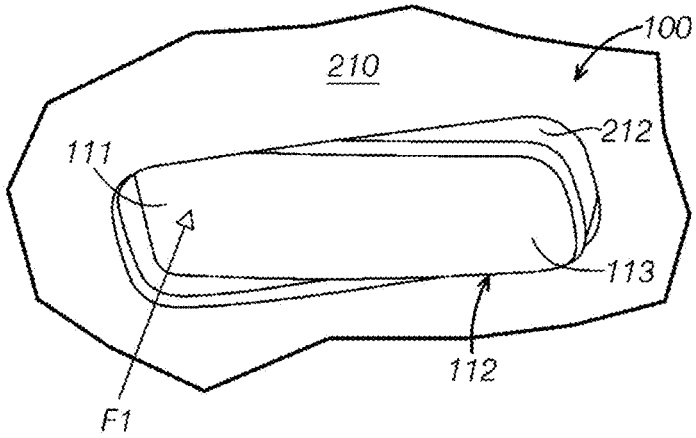
[FIG. 5B]
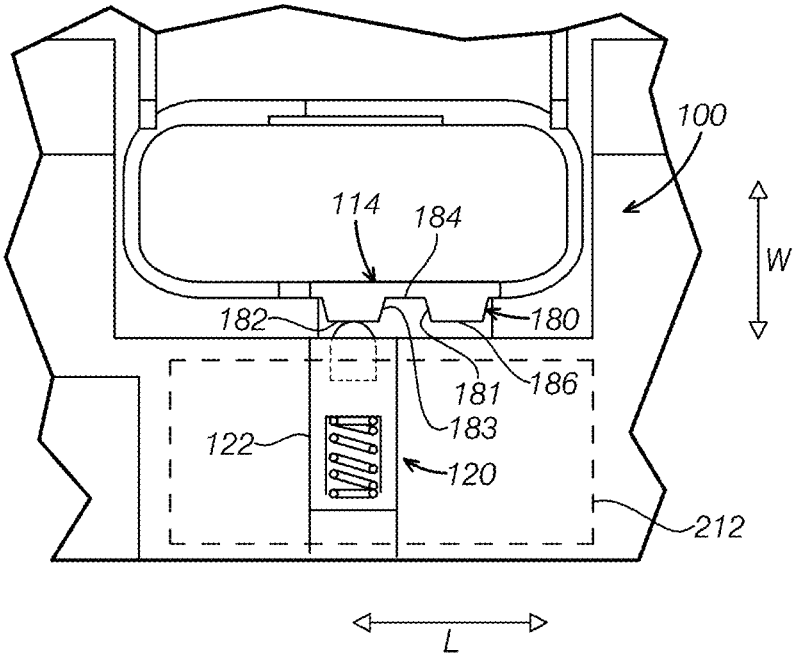

[FIG. 5C]
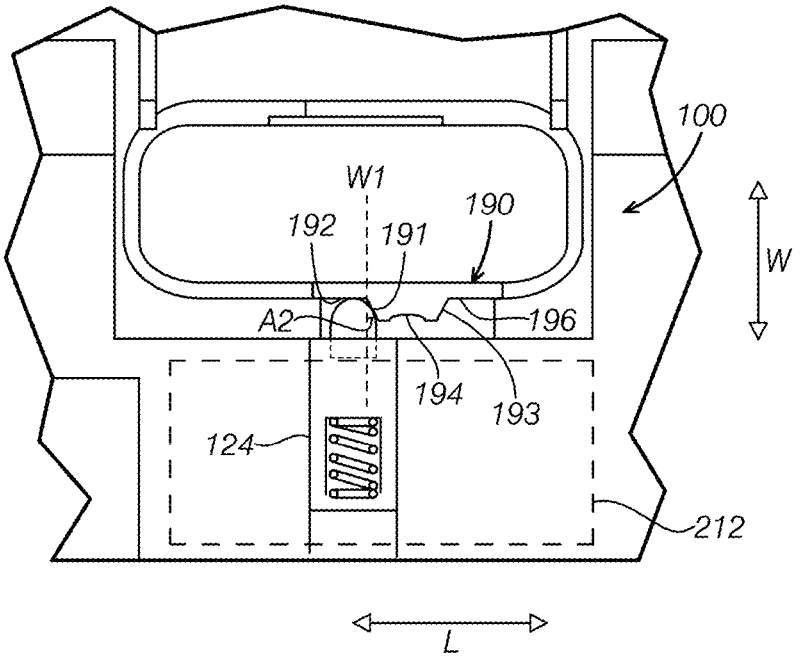
[FIG. 5D]
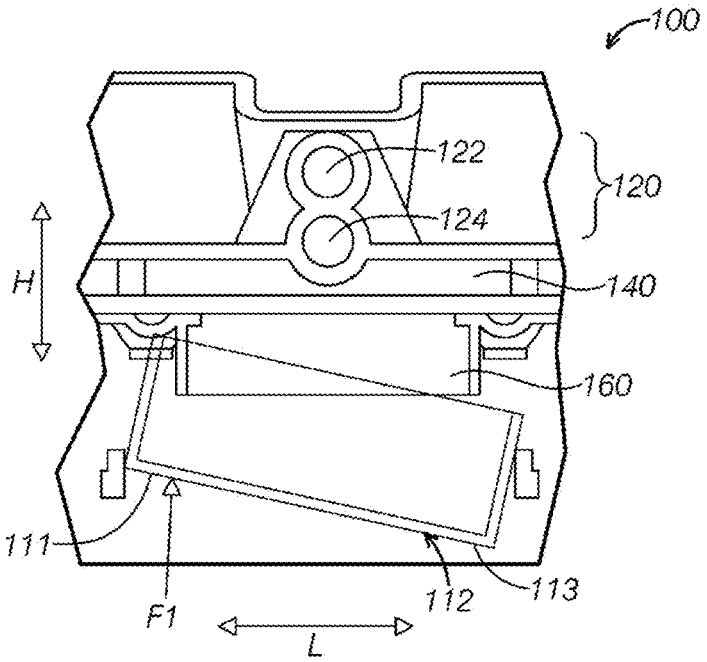

[FIG. 6A]
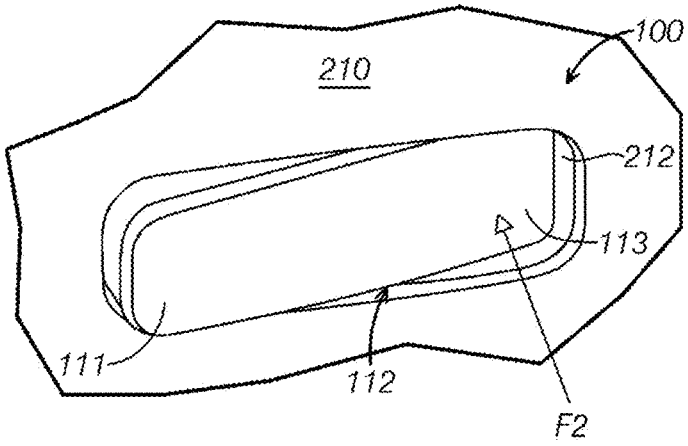
[FIG. 6B]
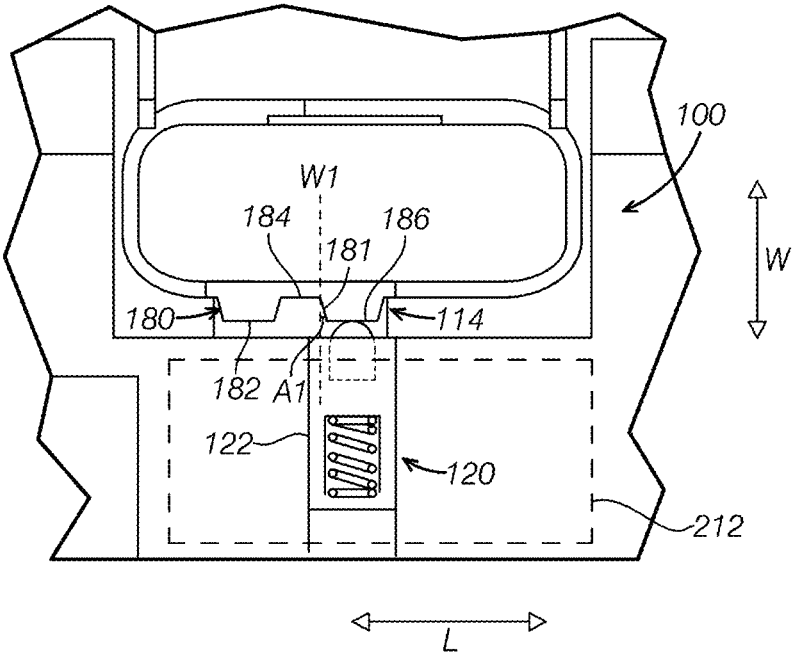

[FIG. 6C]
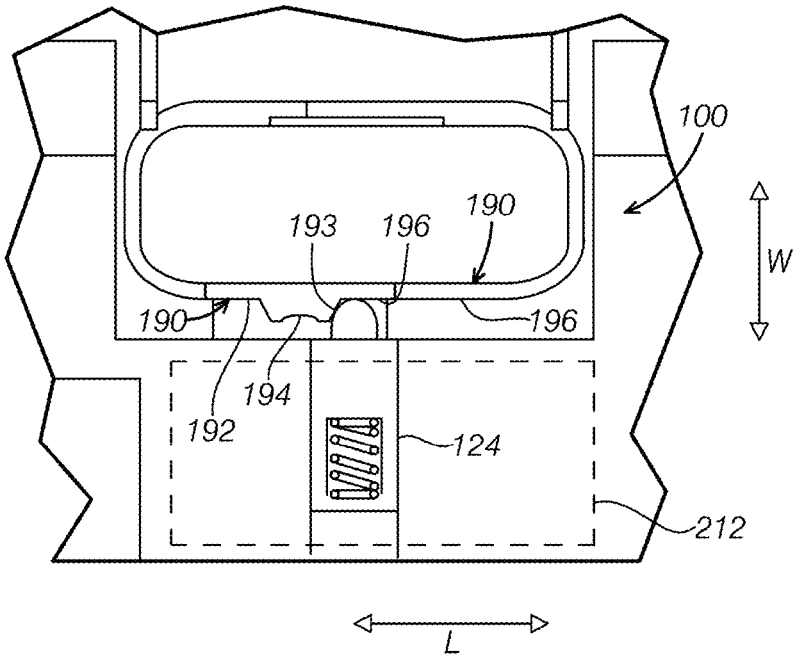
[FIG. 6D]
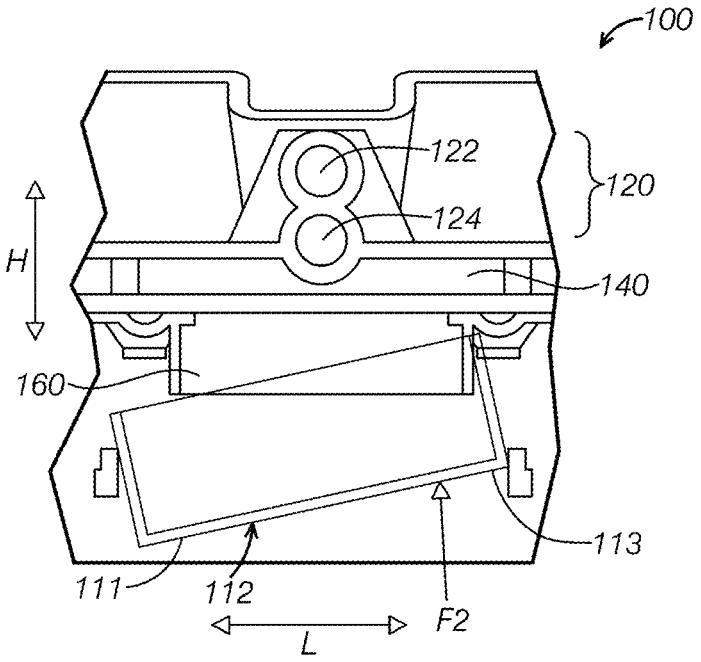

[FIG. 7]
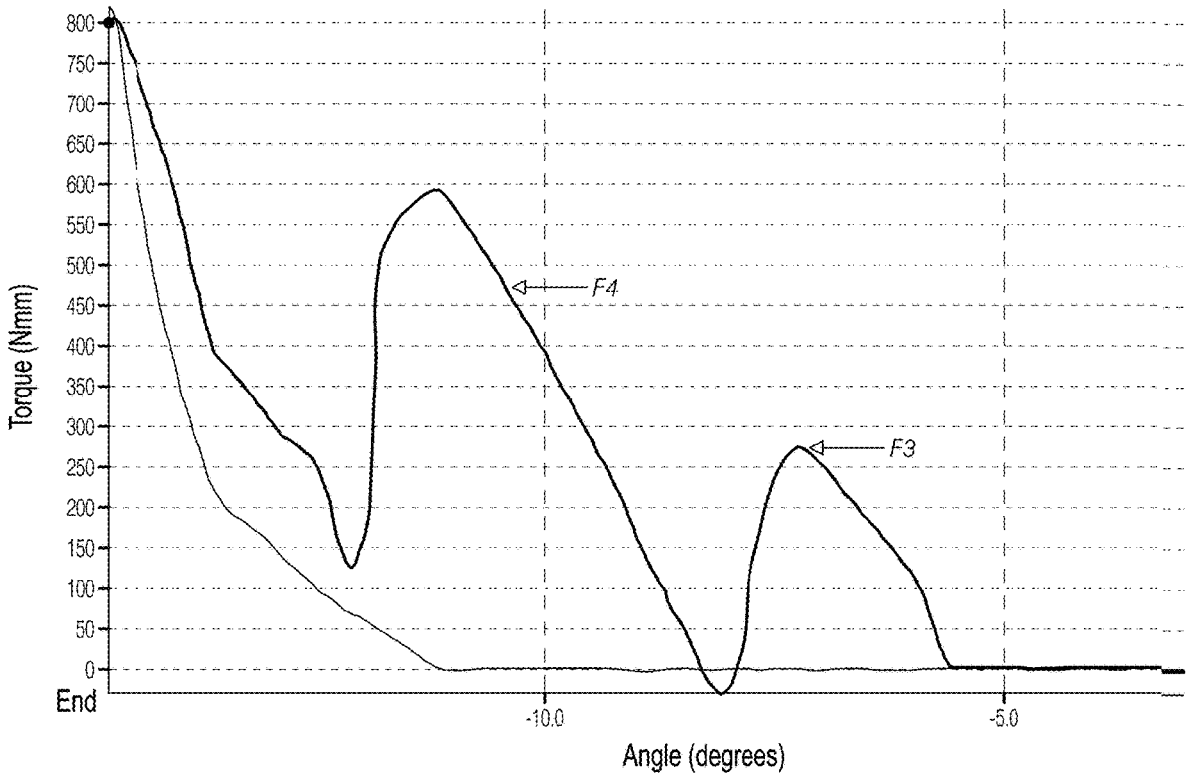

SWITCH ASSEMBLY

FIELD OF THE INVENTION

The present invention generally relates to a switch assembly providing multi-level control, and more particularly relates to a switch assembly that can be switched among various states and, in one example, can be used for vehicle ceiling lights.

BACKGROUND OF THE INVENTION

Switches have been widely applied in the fields of electrical appliances and vehicles. A switch sometimes may need to be mounted in a limited space, such as on an electrical panel or on a vehicle headliner. Furthermore, the switch may need to provide multi-level control, achieve tactility, and ensure electrical contact. When switching among various levels, one may switch to an unexpected level since the pressing force applied to the switch button may be hard to control. For instance, if too much pressing force is applied, one may skip the desired level and switch to another level.

SUMMARY OF THE INVENTION

The present disclosure provides a switch assembly having a plurality of states and facilitating users switching to a desired state. According to one aspect of the present invention, the switch assembly includes a button having a first state, a second state, and a third state that are different from each other, a pivoting element extending from a height direction of the button, the pivoting element having a first contact part and a second contact part that are arranged in the height direction, wherein surfaces of the first contact part and the second contact part have different contours, and a first positioning element and a second positioning element corresponding to the first contact part and the second contact part, respectively, and being movable relative to each other, wherein the first positioning element and a first positioning section of the first contact part functions to configured the first state, the second positioning element and a second positioning section of the second contact part function to configure the second state, and the second positioning element and a third positioning section of the second contact part function to configure to the third state.

In some embodiments, the first positioning section of the first contact part is recessed, the first contact part sequentially comprises, in a lengthwise direction of the button, a protruding first contact section, the recessed first positioning section, and a protruding second contact section; and the lengthwise direction is perpendicular to the height direction. The second contact part sequentially comprises, in the lengthwise direction, the second positioning section, a protruding third contact section, and the third positioning section. The pivoting element, the first positioning element, and the second positioning element are configured to cause a force exerted to move the first positioning element out of the first positioning section to be greater than a force exerted to move the second positioning element out of the second positioning section, and to be greater than a force exerted to move the second positioning element out of the third positioning section.

In some embodiments, the first positioning element and the second positioning element respectively comprise a first elastic part and a second elastic part, and the direction of an elastic force of the first elastic part and the second elastic part are substantially perpendicular to surfaces of the first contact part and the second contact part. In some embodiments, the first elastic part has a greater elastic modulus compared with the second elastic part.

In some embodiments, a coefficient of friction of a side wall of the first positioning section of the first contact part is greater than a coefficient of friction of a side wall of the second positioning section of the second contact part, and is greater than a coefficient of friction of a side wall of the third positioning section of the second contact part.

In some embodiments, a slope of a side wall of the first positioning section of the first contact part is greater than a slope of a side wall of the second positioning section of the second contact part, and is greater than a slope of a side wall of the third positioning section of the second contact part.

In some embodiments, angles of two side walls of the first positioning section of the first contact part relative to a bottom wall thereof are approximately 90 degrees, or the two side walls are respectively inclined towards the first contact section and the second contact section, and inner side walls of the second positioning section and the third positioning section of the second contact part are both inclined towards the third contact section.

According to another aspect of the present application, a switch assembly is disclosed. The switch assembly comprises a switch unit and a positioning unit. The switch unit comprises a button and a pivoting element extending from a height direction of the button, and the pivoting element has a first contact part and a second contact part that are arranged in the height direction. The positioning unit comprises a first positioning element and a second positioning element that are arranged in the height direction, and the first positioning element and the second positioning element is, in a widthwise direction perpendicular to the height direction, movable respectively relative to the first contact part and the second contact part so as to position the switch unit in different positions. The first contact part comprises, in a lengthwise direction of the switch unit, a protruding first contact section, a protruding second contact section, and a recessed first positioning section located between the first contact section and the second contact section, and the lengthwise direction being perpendicular to both the height direction and the widthwise direction. The second contact part comprises, in the lengthwise direction, a second positioning section, a third positioning section, and a protruding third contact section located between the first positioning section and the second positioning section. The maximum value of a force exerted to move the first positioning element out of the first positioning section is greater than the maximum value of a force exerted to move the second positioning element out of the second positioning section, and is greater than the maximum value of a force exerted to move the second positioning element out of the third positioning section.

In some embodiments, the switch assembly further comprises a housing having an opening and a shaft passing through the opening in the widthwise direction, the button being at least partially accommodated in the opening, and being pivotable around the shaft.

In some embodiments, the first positioning element comprises a first columnar body and a first elastic part extending along a central axis of the first columnar body, and the central axis of the first columnar body is perpendicular to a main plane of the pivoting element. The second positioning element comprises a second columnar body and a second elastic part extending along a central axis of the second columnar body, and the central axis of the second columnar body is parallel to the central axis of the first columnar body.

In some embodiments, the first elastic part has a greater elastic modulus compared with the second elastic part.

In some embodiments, a coefficient of friction of a side wall of the first positioning section of the first contact part is greater than a coefficient of friction of a side wall of the second positioning section of the second contact part, and is greater than a coefficient of friction of a side wall of the third positioning section of the second contact part.

In some embodiments, a slope of a side wall of the first positioning section of the first contact part is greater than a slope of a side wall of the second positioning section of the second contact part, and is greater than a slope of a side wall of the third positioning section of the second contact part.

In some embodiments, the switch unit further comprises a connecting part that connects, in the widthwise direction, the button to the pivoting element.

In some embodiments, the switch assembly further comprises a control circuit located between the button and the positioning unit. In some embodiments, the switch assembly further comprises a circuit protection cover located above the control circuit, and the positioning unit is integrated on the circuit protection cover. In some embodiments, the switch assembly further comprises a conductive spacer located between the control circuit and the button, the spacer being made from an elastic material, and contains a conductive material so as to assist connection of the control circuit.

According to another aspect of the present application, a switch assembly of a vehicle ceiling light is disclosed. The switch assembly comprises a button having a turned-on state, an automatic state, and a turned-off state, a pivoting element extending from the button in a height direction thereof, the pivoting element having a first contact part and a second contact part that are arranged in the height direction, and surfaces of the first contact part and the second contact part having different contours, wherein the first contact part comprises, in a lengthwise direction of the button, a protruding first contact section, a protruding second contact section, and a recessed first positioning section located between the first contact section and the second contact section, and the lengthwise direction is perpendicular to the height direction, wherein the second contact part comprises, in the lengthwise direction, a recessed second positioning section, a recessed third positioning section, and a protruding third contact section located between the first positioning section and the second positioning section, and a first positioning element and a second positioning element respectively corresponding to the first contact part and the second contact part, and being movable in a widthwise direction of the button, wherein the first positioning element and the first positioning section of the first contact part function to configure the automatic state, the second positioning element and the second positioning section of the second contact part function to configure the turn-on state, and the second positioning element and the third positioning section of the second contact part function to configure the turned-off state.

In some embodiments, the first elastic part has a greater elastic modulus compared with the second elastic part, and a slope of a side wall of the first positioning section of the first contact part is greater than a slope of a side wall of the second positioning section of the second contact part, and is greater than a slope of a side wall of the third positioning section of the second contact part.

In some embodiments, a coefficient of friction of a side wall of the first positioning section of the first contact part is greater than a coefficient of friction of a side wall of the second positioning section of the second contact part, and is greater than a coefficient of friction of a side wall of the third positioning section of the second contact part.

It should be understood that the above brief description is provided for introducing, in a simplified form, a series of selected concepts that will be further described in the detailed description. The above brief description is not meant to define key or essential features of the subject matter of the present invention, and the scope of the present invention is only defined by the claims of the present invention.

These and other aspects, objects, and features of the present invention will be understood and appreciated by those skilled in the art upon studying the following specification, claims, and appended drawings.

BRIEF DESCRIPTION OF THE DRAWINGS

In the drawings:

With reference to the accompanying drawings and one or a plurality of embodiments described in detail below, one or a plurality of features and/or advantages of the present disclosure will become apparent.

FIG. 1 is a bottom view of a switch assembly according to an embodiment of the present application, showing a switch assembly in a first state in a vehicle;

FIG. 2 is a perspective assembly view of the switch assembly of FIG. 1;

FIG. 3A is an exploded perspective view of the switch assembly of FIG. 1;

FIG. 3B is an enlarged perspective view of a switch unit of the switch assembly of FIG. 3A;

FIG. 4A is a bottom view of a button when the switch assembly of FIG. 1 is in a first state;

FIG. 4B is a schematic view of a cross section passing through a first contact part of a switch unit and a first positioning element of a positioning unit when the switch assembly of FIG. 1 is in a first state;

FIG. 4C is a schematic view of a cross section passing through a second contact part of a switch unit and a second positioning element of a positioning unit when the switch assembly of FIG. 1 is in a first state;

FIG. 4D is a side view of a part of a switch assembly in a second state;

FIG. 5A is a bottom view of a button when the switch assembly of FIG. 1 is in a second state;

FIG. 5B is a schematic view of a cross section passing through a first contact part of a switch unit and a first positioning element of a positioning unit when the switch assembly of FIG. 1 is in a second state;

FIG. 5C is a schematic view of a cross section passing through a second contact part of a switch unit and a second positioning element of a positioning unit when the switch assembly of FIG. 1 is in a second state;

FIG. 5D is a side view of a part of a switch assembly in a second state;

FIG. 6A is a bottom view of a button when the switch assembly of FIG. 1 is in a third state;

FIG. 6B is a schematic view of a cross section passing through a first contact part of a switch unit and a first positioning element of a positioning unit when the switch assembly of FIG. 1 is in a third state;

FIG. 6C is a schematic view of a cross section passing through a second contact part of a switch unit and a second positioning element of a positioning unit when the switch assembly of FIG. 1 is in a third state;

FIG. 6D is a side view of a part of a switch assembly in a second state; and FIG. 7 is a curve graph of a force applied to a button of a switch assembly when the button is switched among a first state, a second state, and a third state according to an embodiment of the present application.

DETAILED DESCRIPTION OF THE PREFERRED EMBODIMENTS

The description of the present disclosure discloses specific embodiments; however, it should be understood that the embodiments disclosed herein are merely examples of the present application that can be implemented in various and alternative forms. The drawings are not necessarily drawn to scale, and some features may be enlarged or reduced so as to show details of a specific component. The same or similar reference numerals can refer to the same parameters and components or modifications and alternatives similar thereto. In the following description, a plurality of operational parameters and components are described in a plurality of conceived embodiments. These specific parameters and components are merely exemplary in the description and are not intended for limitation. Therefore, the specific structures and functional details disclosed in the description shall not be construed as a limitation, but are merely representative bases for teaching those skilled in the art to implement the present application in various forms.

FIG. 1 is a schematic bottom view of a part of a vehicle 200 having a switch assembly 100. FIG. 2 is a schematic perspective view of a part of the vehicle 100 in FIG. 1, showing the assembled switch assembly 100. Referring to FIG. 1 and FIG. 2, the switch assembly 100 includes a switch unit 110 and a positioning unit 120. The switch unit 110 has a button 112 and a pivoting element 114 extending from a height direction H of the button 112. A ceiling inner panel 210 (e.g., a headliner facing a passenger compartment) of the vehicle 200 has an opening 212, and the button 112 is accommodated in the opening 212. In a first state, an outer surface 115 of the button 112 is substantially flush with a surface 211 of the ceiling inner panel 210. The other part of the switch assembly 100 is substantially hidden between the ceiling inner panel 210 and a top outer panel (a metal panel facing the outside of the vehicle, not shown in FIG. 1).

The button 112 can have three different states, i.e., the first state, a second state, and a third state. As shown in FIG. 1, in a lengthwise direction L, two end parts (e.g., a first end part 111 and a second end part 113) of the button 112 are two opposite edge parts of the button 112. In the first state, the first end part 111 and the second end part 113 of the button 112 are substantially flush with the surface of the inner panel 210. In some embodiments, in the first state, a ceiling light (not shown) controlled by the switch assembly 100 is in an automatic mode, and in response to opening of a vehicle door, the ceiling light is automatically turned on so as to illuminate a compartment and to allow a user to easily enter the vehicle, and after a predetermined time, the ceiling light is automatically turned off.

The second state and the third state can respectively correspond to a manual turning on mode and a manual turning off mode of the ceiling light; in response to a pressing force from the user's finger, one of the first end part 111 and the second end part 113 of the button 112 partially enters into the opening 212, and selectively connects or disconnects a control circuit connected to the button 112, such that the ceiling light is manually turned on or off.

FIG. 3A is an exploded perspective view of the switch assembly 100, and FIG. 3B is an enlarged perspective view of the switch unit 110. The switch unit 110 has a button 112 and a pivoting element 114 extending from a height direction H of the button 112. The pivoting element 114 has two contact parts arranged in the height direction H, e.g., a first contact part 180 and a second contact part 190, and the two contact parts can be, in the height direction H, adjacent to each other (as shown in FIG. 2) or spaced apart from each other (not shown). The positioning unit 120 can include two positioning elements arranged in the height direction, e.g., a first positioning element 122 and a second positioning element 124, and the two positioning elements are, in the height direction H, spaced apart from each other, and respectively and independently contact the first contact part 180 and the second contact part 190. A surface 180*a* of the first contact part 180 and a surface 190*a* of the second contact part 190 have different contours, and the first positioning element 122 and the second positioning element 124 are movable in a widthwise direction W of the button 112, such that when the pivoting element 114 pivots, the first positioning element 122 and the second positioning element 124 stay in different positions respectively on the first contact part 180 and the second contact part 190.

It should be understood that the lengthwise direction L, the widthwise direction W, and the height direction H of the button 112 are perpendicular to each other, and can respectively correspond to a widthwise direction, a lengthwise direction or a front-rear direction, and a height direction of the vehicle 200.

The switch assembly 100 can include a housing 130, the housing 130 having an opening 132 and a shaft 134 passing through the opening 132 in the widthwise direction W. The button 112 is partially accommodated in the opening 132, and is pivotable around the shaft 134. In the height direction H, the opening 212 of the ceiling inner panel 210 is flush with the opening 132 of the housing 130 and is located above the opening 132. In response to a pressing force, one of the first end part 111 and the second end part 113 of the button 112 pivots due to the pressing force applied thereto and at least partially enters into the opening 132. The pivoting element 114 connected to the button 112 can pivot left and right parallel to a main plane P (e.g., a plane defined by the lengthwise direction L and the height direction H) of the pivoting element 114, such that a contact position of the first contact part 180 and the first positioning element 122 and a contact position of the second contact part 190 and the second positioning element 124 can vary in response to the button 112 being pressed.

Referring to FIGS. 3A and 3B, the pivoting element 114 can be connected to a first side 117 of the button 112 by a connecting part 116. The first side 117 extends in the lengthwise direction L, and is located between the first end part 111 and the second end part 113. The pivoting element 114, the connecting part 116, and the button 112 can be integrally formed. In the embodiment shown in the drawings, the connecting part 116 extends in the widthwise direction such that the pivoting element 114 and the button 112 are spaced apart by a certain distance. Alternatively, the pivoting element 114 can also be directly fixed to the first side 117 of the button 112 without the need for a connecting part.

The first contact part 180 sequentially has, in the lengthwise direction L, a protruding first contact section 182, a recessed first positioning section 184, and a protruding second contact section 186. For example, the first positioning section 184 can be a recess defined between the first contact section 182 and the second contact section 186. When the pivoting element 114 pivots, the first positioning element 122 can move, in the widthwise direction W, to the first positioning section 184 so as to position the pivoting element 114, such that the switch assembly 100 is in the first state.

The second contact part 190 sequentially has, in the lengthwise direction L, a second positioning section 192, a protruding third contact section 194, and a third positioning section 196. For example, the third contact section 194 is located between the second positioning section 192 and the third positioning section 196, and protrudes from the main plane P of the pivoting element 114. Compared with the protruding third contact section 194, the second positioning section 192 and the third positioning section 196 are recessed structures. When the pivoting element 114 pivots, the second positioning element 124 can move, in the widthwise direction W, to the second positioning section 192 or the third positioning section 196 so as to position the pivoting element 114, such that the switch assembly 100 is in the second state or the third state.

The first positioning element 122 and the second positioning element 124 can have the same or similar structures; the two extend in the widthwise direction W, and are spaced apart in the height direction H. The first positioning element 122 has a first columnar body 121 and a first elastic part 123 connected thereto. A central axis O1 of the first columnar body 121 is parallel to the widthwise direction W, i.e., perpendicular to the main plane P. The first elastic part 123 extends in a direction parallel to the central axis O1 and can apply a force in the widthwise direction W to the first columnar body 121, such that the first columnar body 121 is movable in the widthwise direction W. Similarly, the second positioning element 124 has a second columnar body 125 and a second elastic part 127 connected thereto. A central axis O2 of the second columnar body 121 is parallel to the widthwise direction W, i.e., perpendicular to the main plane P. The second elastic part 127 extends in a direction parallel to the central axis O2 and can apply a force in the widthwise direction W to the second columnar body 125, such that the second columnar body 125 is movable in the widthwise direction W.

The switch assembly 100 further includes a control circuit 140 arranged, in the height direction H, between the button 112 and the positioning unit 120. In response to a pressing force applied by the user to the first end part 111 or the second end part 113 of the button 112, the positioning unit 120 positions the pivoting element 114 in different positions (e.g., the first positioning section 184 of the first contact part 180 or the second positioning section 192 or the third positioning section 196 of the second contact part 190), such that the control circuit 140 is connected or disconnected, the switch assembly 100 is in the second state or the third state; and the ceiling light is manually turned on or off The switch assembly 100 further includes a circuit protection cover 150 arranged, in the height direction H, above the control circuit 140. Compared with the control circuit 140, the circuit protection cover 150 can have a larger area and has a protruding edge 152 extending downwards, such that a side surface of the control circuit 140 can also be protected. The positioning unit 120 can be integrated on the circuit protection plate 150, such that the switch assembly 100 is more structurally compact as a whole. Referring to FIG. 3A, the first positioning element 122 and the second positioning element 124 are respectively arranged in two separate sleeves of the circuit protection plate 150.

The switch assembly 100 further includes a conductive spacer 160 arranged, in the height direction H, between the button 112 and the control circuit 140. The conductive spacer 160 is made from an elastic material, and is deformable in response to a force from the button 112. In addition, the conductive spacer 160 contains a conductive material, thus when the conductive spacer 160 deforms, the control circuit 140 connected thereto can be connected or disconnected, and such that the switch assembly 100 is in a different state, such as the second state or the third state.

FIGS. 4A-4D are schematic views of a plurality of components when the switch assembly 100 is in the first state. FIG. 4A is a bottom view of the button 112. FIG. 4B is a schematic view of a cross section of a combination of the positioning unit 120 and the pivoting element 114. The cross section passes through the first contact part 180 and the first positioning element 122. FIG. 4C is a schematic view of a cross section of a combination of the positioning unit 120 and the pivoting element 114. The cross section passes through the second contact part 190 and the second positioning element. FIG. 4D is a part of a side view of the switch assembly 100. Referring to FIGS. 4A-4D, in the first state, the outer surface of the button 112 is substantially flush with the surface of the ceiling inner panel 210. In other words, both the first end part 111 and the second end part 113 are substantially flush with the ceiling inner panel 210. The first positioning element 122 engages with the first positioning section 184 of the first contact part 180 so as to position the pivoting element 114 in this position, as shown in FIG. 4B. The second positioning element 124 stays on the third contact section 194 of the second contact part 190, as shown in FIG. 4C. The button 112 does not pivot, and therefore applies no force to the elastic conductive spacer 160, such that the conductive spacer 160 does not deform. Referring to FIG. 4D, in the first state, the control circuit 140 is in a selectively connected state. The control circuit 140 is connected in response to a signal of a door opening so as to turn on the ceiling light; the control circuit 140 is disconnected after being turned on for a predetermined time so as to turn off the ceiling light. In some embodiments, the first state is an automatic state.

FIGS. 5A-5D are schematic views of a plurality of components when the switch assembly 100 is in the second state. FIG. 5A is a bottom view of the button 112. FIG. 5B is a schematic view of a cross section of a combination of the positioning unit 120 and the pivoting element 114. The cross section passes through the first contact part 180 and the first positioning element 122. FIG. 5C is a schematic view of a cross section of a combination of the positioning unit 120 and the pivoting element 114. The cross section passes through the second contact part 190 and the second positioning element 124. FIG. 5D is a part of a side view of the switch assembly 100. Referring to FIGS. 5A-5D, in the second state, the first end part 111 of the button 112 pivots into the opening 212 due to a pressing force F1 from, for example, the user.

In the second state, the pivoting element 114 connected to the button 112 pivots in response to a force applied to the button 112, such that a position corresponding to the positioning unit 120 is switched from the position in FIG. 4B (e.g., a middle position) to the position in FIG. 5B (e.g., a left side position). In this case, the first positioning element 122 stays on the protruding first contact section 182 of the first contact part 180, as shown in FIG. 5B. The second positioning element 124 engages with the recessed second positioning section 192 of the second contact part 190 so as to cause the pivoting element 114 to stay in this position, as shown in FIG. 5C.

As shown in FIG. 5D, the first end part 111 of the button 112 pivots into the opening 212 and applies a force to the elastic conductive spacer 160. The conductive spacer 160 deforms (not shown), such that the control circuit 140 is connected, and the ceiling light can be turned on. In this way, the user can manually turn on the ceiling light by applying the force F1 to the first end part 111 of the button 112. In some embodiments, the second state is a turned-on state.

FIGS. 6A-6D are schematic views of a plurality of components when the switch assembly 100 is in the third state. FIG. 6A is a bottom view of the button 112. FIG. 6B is a schematic view of a cross section of a combination of the positioning unit 120 and the pivoting element 114; the cross section passes through the first contact part 180 and the first positioning element 122. FIG. 6C is a schematic view of a cross section of a combination of the positioning unit 120 and the pivoting element 114. The cross section passes through the second contact part 190 and the second positioning element 124. FIG. 6D is a part of a side view of the switch assembly 100. Referring to FIGS. 6A-6D, in the third state, the second end part 113 of the button 112 pivots into the opening 212 due to a pressing force F2 from, for example, the user.

In the third state, the pivoting element 114 connected to the button 112 pivots in response to a force applied to the button 112, such that a position corresponding to the positioning unit 120 is switched from the position in FIG. 4B (e.g., a middle position) to the position in FIG. 6B (e.g., a right side position). In this case, the first positioning element 122 stays on the protruding second contact section 186 of the first contact part 180, as shown in FIG. 6B. The second positioning element 124 engages with the recessed third positioning section 196 of the second contact part 190 so as to cause the pivoting element 114 to stay in this position, as shown in FIG. 6C.

As shown in FIG. 6D, the second end part 113 of the button 112 pivots into the opening 212 and applies a force to the elastic conductive spacer 160, and the conductive spacer 160 deforms (not shown), such that the control circuit 140 is disconnected, and the ceiling light can be turned off. In this way, the user can manually turn off the ceiling light by applying the force F2 to the second end part 113 of the button 112. In some embodiments, the third state is a turned-off state.

Referring to FIGS. 4B, 4C, 5B, and 5C, when switching from the second state (e.g., the turned-on state) of FIG. 5 to the first state (e.g., the automatic state) of FIG. 4 is performed, from the first contact section 182 of the first contact part 180, the first positioning element 122 enters into the first positioning section 184. In this case, a force that the first positioning element 122 needs to overcome is $F_{1R}$. In addition, from the first positioning section 192 of the second contact part 190, the second positioning element 124 enters into the third contact section 194. In this case, a force that the second positioning element 124 needs to overcome is $F_{2R}$. In the embodiments shown in the drawings, from the protruding first contact section 182, the first positioning member 122 enters into the recessed first positioning section 184, and from the recessed first positioning section 124 and over a certain height, the second positioning element 124 enters into the third contact section 194. Therefore, from the second state to the first state, the force $F_{1R}$ that the first positioning element 122 needs to overcome is lighter than the force $F_{2R}$ that the second positioning element 124 needs to overcome. A force F3 applied by the user to the button is substantially used to overcome the force $F_{2R}$ that the second positioning element 124 needs to overcome to pivot.

When switching from the automatic state of FIGS. 4A-4D to the turned-off state of FIGS. 6A-6D is performed, in the embodiment shown in the drawings, from the first positioning section 184 of the first contact part 180, the first positioning element 122 enters into the second contact section 186. In this case, a force that the first positioning element 122 needs to overcome is $F_{3R}$. In addition, from the third contact section 194 of the second contact part 190, the second positioning element 124 enters into the third positioning section 196. In this case, a force that the second positioning element 124 needs to overcome is $F_{4R}$. From the recessed first positioning section 184 and over a certain height, the first positioning member 122 enters into the protruding second contact section 186, and from the protruding third contact section 194, the second positioning element 124 slides into the third contact section 194. Therefore, from the first state to the third state, the force $F_{3R}$ that the first positioning element 122 needs to overcome is greater than the force $F_{4R}$ that the second positioning element 124 needs to overcome. A force F4 applied by the user to the button is substantially used to overcome the force $F_{3R}$ that the first positioning element 122 needs to overcome to pivot.

If the force $F_{3R}$ that the first positioning element 122 needs to overcome to pivot is greater than the force $F_{2R}$ that the second positioning element 124 needs to overcome to pivot, when switching from the first state (e.g., the automatic state) shown in FIGS. 4A-4D to the third state (e.g., the turned-off state) of FIGS. 6A-6D is performed, the force F4 that needs to be applied by the user is greater than the force F3 for switching from the second state (e.g., the turned-on state) shown in FIGS. 5A-5D to the first state (e.g., the automatic state) of FIG. 4A-4D. Therefore, the user applies the force F3 in order to switch the switch from the turned-on state to the automatic state, and since the F3 is less than the F4, the switch only switches to the automatic state.

Any applicable method can be used to configure the pivoting element 114, the first positioning element 122, and the second positioning element 124. In some embodiments, the elastic modulus of the first elastic part 123 of the first positioning element 122 can be configured to be greater than the elastic modulus of the second elastic part 127 of the second positioning element 124. The first elastic part 123 and the second elastic part 127 can be coil springs. Since the elastic modulus of the first elastic part 123 is greater than the elastic modulus of the second elastic part 127, when the other parameters (e.g., the slope and coefficient of friction of a side wall) of the second positioning section 192 are equal to those of the first positioning section 184, the force $F_{2R}$ that the second positioning element 124 needs to overcome to enter into the third contact section 194 from the first positioning section 192 of the second contact part 190 is lighter than the force $F_{3R}$ that the first positioning element 122 needs to overcome to enter into the second contact section 186 from the first positioning section 184 of the first contact part 180. Namely, the maximum value of the force F3 that needs to be applied by the user is less than the maximum value of the force F4 that needs to be applied by the user. Compared with performing switching from the turned-on state to the automatic state, performing switching from the turned-on state directly to the turned-off state requires the user to apply a greater force. Similarly, on the basis of the above description, compared with performing switching from the turned-off state to the automatic state, performing switching from the turned-off state of FIGS. 6A-6D directly to the turned-on state of FIGS. 5A-5D also requires the user to apply a greater force.

In some embodiments, the slope of an inner side wall 191 of the second positioning section 192 of the second contact part 190 is less than the slope of an inner side wall 181 of the first positioning section 184 of the first contact part 180, namely, the inner side wall 181 of the first positioning section 184 is steeper compared with the inner side wall 191 of the second positioning section 192 relative to respective bottom walls thereof. In other words, an included angle A1 between the inner side wall 181 of the first positioning section 184 and an axis W1 parallel to the widthwise direction W is less than an included angle A2 between the inner side wall 191 of the second positioning section 192 and the axis W1. Two inner side walls of the first positioning section 184 can have the same slope. The first contact part 180 has a symmetrical structure with respect to a central axis C of the pivoting element 114. The slope of the inner side wall 191 of the second positioning section 192 of the second contact part 190 can be equal to the slope of an inner side wall 193 of the third positioning section 196. The second contact part 190 has a symmetrical structure with respect to the central axis C of the pivoting element 114.

Since the slope of the inner side wall 181 of the first positioning section 184 is greater than the slope of the inner side wall 191 of the second positioning section 192, when the other parameters (e.g., the coefficient of friction) of the second positioning section 192 are equal to those of the first positioning section 184, and the other parameters (e.g., the elastic modulus) of the first elastic part 123 are equal to those of the second elastic part 127, the force $F_{2R}$ that the second positioning element 124 needs to overcome to enter into the third contact section 194 from the first positioning section 192 of the second contact part 190 is lighter than the force $F_{3R}$ that the first positioning element 122 needs to overcome to enter into the second contact section 186 from the first positioning section 184 of the first contact part 180. Namely, the maximum value of the force F3 is less than the maximum value of the force F4. Namely, compared with performing switching from the turned-on state of FIGS. 5A-5D to the automatic state of FIGS. 4A-4D, performing switching from the turned-on state of FIGS. 5A-5D directly to the turned-off state of FIGS. 6A-6D requires the user to apply a greater force.

Similarly, on the basis of the above description, compared with performing switching from the turned-off state of FIGS. 6A-6D to the automatic state of FIGS. 5A-5D, performing switching from the turned-off state of FIGS. 6A-6D directly to the turned-on state of FIGS. 4A-4D also requires the user to apply a greater force.

In some embodiments, the coefficient of friction of the inner side wall 191 of the second positioning section 192 of the second contact part 190 is less than the coefficient of friction of the inner side wall 181 of the first positioning section 184 of the first contact part 180. Since the coefficient of friction of the inner side wall 181 of the first contact part 180 is greater than the coefficient of friction of the inner side wall 191 of the second contact part 190, when the other parameters (e.g., the slope) of the second positioning section 192 are equal to those of the first positioning section 184, and the other parameters (e.g., the elastic modulus) of the first elastic part 123 are equal to those of the second elastic part 127, the maximum value of the force F3 is less than the maximum value of the force F4. Namely, compared with performing switching from the turned-on state of FIGS. 5A-5D to the automatic state of FIGS. 4A-4D, performing switching from the turned-on state of FIGS. 5A-5D directly to the turned-off state of FIG. 6 requires the user to apply a greater force to the button.

Similarly, on the basis of the above description, compared with performing switching from the turned-off state of FIGS. 6A-6D to the automatic state of FIGS. 5A-5D, performing switching from the turned-off state of FIGS. 6A-6D directly to the turned-on state of FIGS. 4A-4D also requires the user to apply a greater force.

In some embodiments, the switch assembly 100 can be configured such that the elastic modulus of the first elastic part 123 of the first positioning element 122 is greater than the elastic modulus of the second elastic part 127 of the second positioning element 124, and the slope of the inner side wall 191 of the second positioning section 192 of the second contact part 190 is less than the slope of the inner side wall 181 of the first positioning section 184 of the first contact part 180. In some embodiments, the switch assembly 100 can be configured such that the elastic modulus of the first elastic part 123 of the first positioning element 122 is greater than the elastic modulus of the second elastic part 127 of the second positioning element 124, and the coefficient of friction of the inner side wall 191 of the second positioning section 192 of the second contact part 190 is less than the coefficient of friction of the inner side wall 181 of the first positioning section 184 of the first contact part 180. In some embodiments, the switch assembly 100 can be configured such that the elastic modulus of the first elastic part 123 of the first positioning element 122 is greater than the elastic modulus of the second elastic part 127 of the second positioning element 124, the slope of the inner side wall 191 of the second positioning section 192 of the second contact part 190 is less than the slope of the inner side wall 181 of the first positioning section 184 of the first contact part 180, and the coefficient of friction of the inner side wall 191 of the second positioning section 192 of the second contact part 190 is less than the coefficient of friction of the inner side wall 181 of the first positioning section 184 of the first contact part 180. In some embodiments, the switch assembly 100 can be configured such that the slope of the inner side wall 191 of the second positioning section 192 of the second contact part 190 is less than the slope of the inner side wall 181 of the first positioning section 184 of the first contact part 180, and the coefficient of friction of the inner side wall 191 of the second positioning section 192 of the second contact part 190 is less than the coefficient of friction of the inner side wall 181 of the first positioning section 184 of the first contact part 180.

FIG. 7 is a curve graph obtained by performing a torque test experiment on a switch assembly according to an embodiment of the present application. The curve graph shows the relationship between a displacement of a button and a pressing force applied to the button when switching is performed among three different states, where the horizontal axis represents a displacement range of the button represented by an angle, and the vertical axis represents the pressing force applied to the button. With reference to FIG. 7, the curve shown on the right side represents a change of the force F3 when the switch assembly switches from the turned-on state to the automatic state, and the curve in the middle represents a change of the force F4 when the switch assembly switches from the automatic state to the turned-off state. It can be obviously seen that the maximum value of the force F4 is greater than the maximum value of the force F3.

In the switch assembly of the present disclosure, structures and parameters of the switch unit and the positioning unit having two positioning elements are configured, such that when switching is performed among three different states, a user can apply an appropriate force to switch the switch assembly from the turned-on state or the turned-off state to the automatic state between the two, and reducing the possibility of the switch assembly being switched from the turned-on state directly to the undesired turned-off state, or switched from the turned-off state directly to the undesired turned-on state.

The above description merely shows preferred embodiments of the present application, and is not intended to limit the present application. Various changes and modifications can be made to the present application by those skilled in the art. Any modification, equivalent replacement, and improvement made without departing from the spirit and principle of the present application shall fall within the protection scope of the present application.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A switch assembly, comprising:

a button having a first state, a second state, and a third state that are different from each other;

a pivoting element extending from a height direction of the button, the pivoting element having a first contact part and a second contact part that are arranged in the height direction, wherein surfaces of the first contact part and the second contact part have different contours; and a first positioning element and a second positioning element corresponding to the first contact part and the second contact part, respectively, and being movable relative to each other, wherein the first positioning element and a first positioning section of the first contact part function to configure the button in the first state, the second positioning element and a second positioning section of the second contact part function to configure the button in the second state, and the second positioning element and a third positioning section of the second contact part function to configure the button in the third state.

2. The switch assembly according to claim 1, wherein the first positioning section of the first contact part is recessed, and wherein the first contact part sequentially comprises, in a lengthwise direction of the button, a protruding first contact section, the recessed first positioning section, and a protruding second contact section, and the lengthwise direction being perpendicular to the height direction;

wherein the second contact part sequentially comprises, in the lengthwise direction, the second positioning section, a protruding third contact section, and the third positioning section; and wherein the pivoting element, the first positioning element, and the second positioning element are configured to cause a force exerted to move the first positioning element out of the first positioning section to be greater than a force exerted to move the second positioning element out of the second positioning section, and to be greater than a force exerted to move the second positioning element out of the third positioning section.

3. The switch assembly according to claim 2, wherein the first positioning element and the second positioning element respectively comprise a first elastic part and a second elastic part, and the direction of an elastic force of the first elastic part and the second elastic part are substantially perpendicular to surfaces of the first contact part and the second contact part.

4. The switch assembly according to claim 3, wherein the first elastic part has a greater elastic modulus compared with the second elastic part.

5. The switch assembly according to claim 2, wherein a coefficient of friction of a side wall of the first positioning section of the first contact part is greater than a coefficient of friction of a side wall of the second positioning section of the second contact part, and is greater than a coefficient of friction of a side wall of the third positioning section of the second contact part.

6. The switch assembly according to claim 2, wherein a slope of a side wall of the first positioning section of the first contact part is greater than a slope of a side wall of the second positioning section of the second contact part, and is greater than a slope of a side wall of the third positioning section of the second contact part.

7. The switch assembly according to claim 2, wherein angles of two side walls of the first positioning section of the first contact part relative to a bottom wall thereof are approximately 90 degrees, or the two side walls are respectively inclined towards the first contact section and the second contact section, and inner side walls of the second positioning section and the third positioning section of the second contact part are both inclined towards the third contact section.

8. A switch assembly, comprising:

a switch unit comprising a button and a pivoting element extending from a height direction of the button, the pivoting element having a first contact part and a second contact part that are arranged in the height direction; and a positioning unit comprising a first positioning element and a second positioning element that are arranged in the height direction, the first positioning element and the second positioning element being, in a widthwise direction perpendicular to the height direction, movable respectively relative to the first contact part and the second contact part so as to position the switch unit in different positions;

wherein the first contact part comprises, in a lengthwise direction of the switch unit, a protruding first contact section, a protruding second contact section, and a recessed first positioning section located between the first contact section and the second contact section, the lengthwise direction being perpendicular to both the height direction and the widthwise direction;

wherein the second contact part comprises, in the lengthwise direction, a second positioning section, a third positioning section, and a protruding third contact section located between the first positioning section and the second positioning section; and wherein a maximum value of a force exerted to move the first positioning element out of the first positioning section is greater than a maximum value of a force exerted to move the second positioning element out of the second positioning section, and is greater than a maximum value of a force exerted to move the second positioning element out of the third positioning section.

9. The switch assembly according to claim 8, further comprising a housing having an opening and a shaft passing through the opening in the widthwise direction, the button being at least partially accommodated in the opening, and being pivotable around the shaft.

10. The switch assembly according to claim 8, wherein the first positioning element comprises a first columnar body and a first elastic part extending along a central axis of the first columnar body, and the central axis of the first columnar body is perpendicular to a main plane of the pivoting element;

wherein the second positioning element comprises a second columnar body and a second elastic part extending along a central axis of the second columnar body, and the central axis of the second columnar body is parallel to the central axis of the first columnar body.

11. The switch assembly according to claim 10, wherein the first elastic part has a greater elastic modulus compared with the second elastic part.

12. The switch assembly according to claim 8, wherein a coefficient of friction of a side wall of the first positioning section of the first contact part is greater than a coefficient of friction of a side wall of the second positioning section of the second contact part, and is greater than a coefficient of friction of a side wall of the third positioning section of the second contact part.

13. The switch assembly according to claim 8, wherein a slope of a side wall of the first positioning section of the first contact part is greater than a slope of a side wall of the second positioning section of the second contact part, and is greater than a slope of a side wall of the third positioning section of the second contact part.

14. The switch assembly according to claim 8, wherein the switch unit further comprises a connecting part that connects, in the widthwise direction, the button to the pivoting element.

15. The switch assembly according to claim 8, further comprising a control circuit located between the button and the positioning unit.

16. The switch assembly according to claim 15, further comprising a circuit protection cover located above the control circuit, the positioning unit being integrated on the circuit protection cover.

17. The switch assembly according to claim 15, further comprising a conductive spacer located between the control circuit and the button, the spacer being made from an elastic material and containing a conductive material so as to assist connection of the control circuit.

18. A switch assembly of a vehicle ceiling light, comprising:

a button having a turned-on state, an automatic state, and a turned-off state;

a pivoting element extending from the button in a height direction thereof, the pivoting element having a first contact part and a second contact part that are arranged in the height direction, and surfaces of the first contact part and the second contact part having different contours, wherein the first contact part comprises, in a lengthwise direction of the button, a protruding first contact section, a protruding second contact section, and a recessed first positioning section located between the first contact section and the second contact section, and the lengthwise direction is perpendicular to the height direction, wherein the second contact part comprises, in the lengthwise direction, a recessed second positioning section, a recessed third positioning section, and a protruding third contact section located between the first positioning section and the second positioning section; and a first positioning element and a second positioning element corresponding to the first contact part and the second contact part, and being movable in a widthwise direction of the button, wherein the first positioning element and the first positioning section of the first contact part function to configure the button in the automatic state, the second positioning element and the second positioning section of the second contact part function to configure the button in the turn-on state, and the second positioning element and the third positioning section of the second contact part function to configure the button in the turned-off state.

19. The switch assembly according to claim 18, wherein the first elastic part has a greater elastic modulus compared with the second elastic part, and a slope of a side wall of the first positioning section of the first contact part is greater than a slope of a side wall of the second positioning section of the second contact part, and is greater than a slope of a side wall of the third positioning section of the second contact part.

20. The switch assembly according to claim 19, wherein a coefficient of friction of the side wall of the first positioning section of the first contact part is greater than a coefficient of friction of the side wall of the second positioning section of the second contact part, and is greater than a coefficient of friction of the side wall of the third positioning section of the second contact part.

* * * * *